US010160110B2

(12) United States Patent
Yin

(10) Patent No.: US 10,160,110 B2
(45) Date of Patent: Dec. 25, 2018

(54) OUTPUT-MODE SWITCHING DEVICE FOR ELECTRIC TOOL

(71) Applicant: TRINITY PRECISION TECHNOLOGY CO., LTD., Toufen, Miaoli County (TW)

(72) Inventor: Hsin-Chieh Yin, Taoyuan (TW)

(73) Assignee: TRINITY PRECISION TECHNOLOGY CO., LTD., Toufen, Miaoli County (TW)

( * ) Notice: Subject to any disclaimer, the term of this patent is extended or adjusted under 35 U.S.C. 154(b) by 369 days.

(21) Appl. No.: 15/243,300

(22) Filed: Aug. 22, 2016

(65) Prior Publication Data

US 2017/0282344 A1 Oct. 5, 2017

(30) Foreign Application Priority Data

Mar. 31, 2016 (TW) ..... 105204526 U

(51) Int. Cl.
*B25D 16/00* (2006.01)
*B25B 21/02* (2006.01)
*B25D 11/10* (2006.01)

(52) U.S. Cl.
CPC ..... *B25D 16/006* (2013.01); *B25B 21/023* (2013.01); *B25D 11/106* (2013.01); *B25D 2216/0023* (2013.01); *B25D 2216/0038* (2013.01)

(58) Field of Classification Search
CPC ... B25B 21/004; B25B 13/462; B25B 13/463; B25B 13/46; B25B 21/023; B25D 16/006
USPC ..... 173/20, 29, 178, 48, 47, 90, 217, 131, 173/132, 170–171
See application file for complete search history.

(56) References Cited

U.S. PATENT DOCUMENTS 4,106,572 A * 8/1978 Anderson ..... B25B 21/026 173/93
6,497,316 B1 * 12/2002 Hsu ..... B25B 21/00 173/178
7,410,007 B2 * 8/2008 Chung ..... B25B 21/02 173/176
7,699,566 B2 * 4/2010 Nickels, Jr. ..... B23B 31/1238 279/125
7,854,274 B2 * 12/2010 Trautner ..... B25D 16/006 173/117

(Continued)

*Primary Examiner* — Robert Long
(74) *Attorney, Agent, or Firm* — Rabin & Berdo, P.C.

(57) ABSTRACT

A switching device for an electric tool includes: an output shaft unit disposed in an outer casing, having an output shaft, a movable ratchet wheel mounted such that the movable ratchet wheel is movable axially along the output shaft and is non-rotatable therewith; a fixed ratchet unit having a fixed ratchet wheel sleeved around the output shaft and having ratchet teeth for meshing with ratchet teeth of the movable ratchet wheel; and a function switch unit having a switch ring mounted rotatably on the casing. Rotation of the switch ring about its axis results in rotation of pawls within the switch ring, thereby driving the pawls about its pivot points and meshing and/or non-meshing of the pawls with external ratchet teeth of the fixed ratchet wheel, thereby switching the output shaft among a continuous rotation, rotation in a single direction and simultaneously providing an axial impact during the rotation.

6 Claims, 7 Drawing Sheets

(56) References Cited

U.S. PATENT DOCUMENTS

| | | | | |
|---|---|---|---|---|
| 8,413,549 | B2 * | 4/2013 | Chen | B25B 15/04 81/177.2 |
| 8,517,887 | B2 * | 8/2013 | Chen | B25F 5/001 475/298 |
| 8,851,201 | B2 * | 10/2014 | Limberg | F16D 7/044 173/178 |
| 9,421,681 | B2 * | 8/2016 | Zhang | B25F 5/029 |
| 9,827,660 | B2 * | 11/2017 | Blum | B25D 16/006 |
| 2004/0245005 | A1 * | 12/2004 | Toyama | B25D 16/003 173/48 |
| 2006/0090606 | A1 * | 5/2006 | Spirer | B25B 13/463 81/57.39 |
| 2007/0132196 | A1 * | 6/2007 | Puzio | B23B 31/1253 279/2.21 |
| 2010/0326686 | A1 * | 12/2010 | Leong | B25B 21/00 173/48 |
| 2011/0030984 | A1 * | 2/2011 | Chen | B23B 45/008 173/47 |
| 2011/0214892 | A1 * | 9/2011 | Hecht | B25B 21/00 173/164 |
| 2011/0232930 | A1 * | 9/2011 | Zhang | B25F 5/001 173/178 |
| 2012/0037388 | A1 * | 2/2012 | Yin | B25B 21/02 173/47 |
| 2012/0285712 | A1 * | 11/2012 | Walker | B25B 21/00 173/48 |
| 2013/0025901 | A1 * | 1/2013 | Shi | B25B 21/00 173/216 |
| 2014/0329654 | A1 * | 11/2014 | Andriolo | B25F 5/029 483/1 |

* cited by examiner

OUTPUT-MODE SWITCHING DEVICE FOR ELECTRIC TOOL

CROSS-REFERENCE TO RELATED APPLICATION

This application claims the priority of Taiwanese patent application No. 105204526, filed on Mar. 31, 2016, which is incorporated herewith by reference.

BACKGROUND OF THE INVENTION

1. Field of the Invention

The present invention relates generally to an electric tool, and more particularly to an output-mode switching device for an electric tool such that the switching device can switch among a continuous rotation, rotation in a single direction and rotation and simultaneously providing an axial impact during the rotation.

2. The Prior Arts

A conventional electric tool, like an electric drill, includes a motor, wherein its power is transmitted to an output shaft via a gear system. In order to tightening and/or loosening a screw or a nut smoothly, some electric tools are provided with impact function such that a fully tightened nut can be swiftly loosened and/or a loosely-mounted nut can be swiftly tightened relative to the object.

A conventional output-mode switching device for an electric tool is disclosed. The switching device can switch among a continuous rotation, rotation in a single direction and rotation and providing an axial impact during the rotation. However, it is noted that the structure is relatively complicated due to too many components, thereby incurring high manufacturing expense. In addition, when said switching device is applied in an electric tool, like rotating in a specific direction and simultaneously providing impact function along the axial direct, and in the event that an operating bit rotating in the specific direction is forced to rotate in a direction opposite to the specific direction, the motor and/or other components of the electric tool may be damaged. The reasons reside in that no stop means is provided to prevent the operating bit to rotate in the opposite direction of the specific direction.

SUMMARY OF THE INVENTION

A primary objective of the present invention is to provide an output-mode switching device for an electric tool, which can eliminate the prior drawbacks, the complicated structure having too many components, thereby incurring high manufacturing expense. In the same time, when the switching device is applied in an electric tool, the operating bit can switch among a continuous rotation, rotation in a single direction and rotation and simultaneously providing an axial impact during the rotation. In the event that the operating bit rotating in the specific direction is forced to rotate in a direction opposite to the specific direction, the motor and/or other components of the electric tool are prevented from being damaged.

One distinct feature of the present invention resides in that an output shaft unit is disposed in an outer casing of an electric tool, which further includes a fixed ratchet unit, a torque unit and a function switch unit. The output shaft unit includes an output shaft and a movable ratchet wheel mounted in such a manner that the movable ratchet wheel is movable axially along the shaft and is non-rotatable with the shaft. The fixed ratchet unit includes a fixed ratchet wheel sleeved around the shaft and has ratchet teeth for meshing with movable ratchet teeth of the movable ratchet wheel. The function switch unit includes a switch ring mounted rotatably on the casing, wherein rotation of the switch ring about its axis results in rotation of pawls within the switch ring, thereby driving the pawls about its pivot points and meshing and/or non-meshing of the pawls with external ratchet teeth of the fixed ratchet wheel and switching the output shaft among a continuous rotation, rotation in a single direction and simultaneously providing an axial impact during the rotation.

An output-mode switching device for an electric tool includes: an outer casing, an output shaft unit, a fixed ratchet unit, a toque unit and a function switch unit. The outer casing defines an interior chamber. The output shaft unit is disposed in the interior chamber, includes an output shaft having a first shaft section and a movable ratchet wheel mounted on the first shaft section in such a manner that the movable ratchet wheel is movable axially along the output shaft and is non-rotatable with the output shaft. The movable ratchet wheel has a first end formed with circumferential ratchet teeth on its external surface thereof. The fixed ratchet unit includes a fixed ratchet wheel that is sleeved around the first shaft section and that has a second end formed with ratchet teeth for meshing with the ratchet teeth of the movable ratchet teeth and a restoration spring. The fixed ratchet wheel further has a plurality of external ratchet teeth formed on its outer surface. The restoration spring is being disposed between the movable ratchet wheel and the fixed ratchet wheel and has two opposite ends respectively abutting against the first end of the movable ratchet wheel and the second end of the fixed ratchet wheel. The toque unit includes a torque cover, an annular sleeve coupled with the torque cover, an annular cushion pad having a plurality of inner protrusions and a plurality of compression springs, the torque cover being mounted rotatably on the outer casing. The function switch unit includes a switch ring mounted rotatably on the outer casing behind the toque unit, a plurality of pawls and a plurality of torsion spring which are mounted pivotally within the switch ring so as to extend parallel with an axis of the switch ring such that rotation of the switch ring on the outer casing about its axis results in engagement of the inner protrusions of the annular cushion pad with the pawls, thereby driving the pawls about its pivot points and meshing and/or non-meshing of the pawls with the external ratchet teeth of the fixed ratchet wheel.

In the present embodiment, the output shaft is capable providing axial impact during rotating in a specific direction, the rotation of the output shaft in the specific direction provides high effective, since the output shaft is provided means from rotating in the direction opposite to the specific direction, thereby preventing damage done onto the motor or the other components. Each of The ratchet teeth formed on the second end and the external ratchet teeth formed on its outer surface of the fixed ratchet is asymmetric so is the ratchet teeth formed on the first end of the movable ratchet wheel for meshing and non-meshing with the ratchet teeth of the fixed ratchet wheel.

Preferably, each of the pawls has an abutment section for abutting against a respective one of the inner protrusions of the annular cushion pad, thereby driving the pawls during rotation of the annular cushion pad.

Preferably, the annular cushion pad has an inner wall surface from which the inner protrusions project radially and inwardly toward its axis thereof.

Compared with the prior output-mode switching device for an electric tool, the structure of the components of the present output-mode switching device is relatively simple, thereby lowering the manufacturing expense. In addition, since the output shaft is prevented from rotating in an opposite direction of a specific direction in which the output shaft is rotating, no damage can be done onto the motor and/or the other component of the switching device of the present invention.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

The accompanying drawings are included to provide a further understanding of the invention, and are incorporated in and constitute a part of this specification. The drawings illustrate embodiments of the invention and, together with the description, serve to explain the principles of the invention.

It is to note that when referring a front end of an element, the other end opposite to the front end will be denoted as the second end. Every element will be described in the similar manner in order to better understanding of the present invention.

The present invention is to provide an output-mode switching device for an electric tool (like an electric drill) having an output shaft that can be switched among a continuous rotation, rotation in a single direction and rotation and simultaneously providing an axial impact during the rotation.

Figure 1:
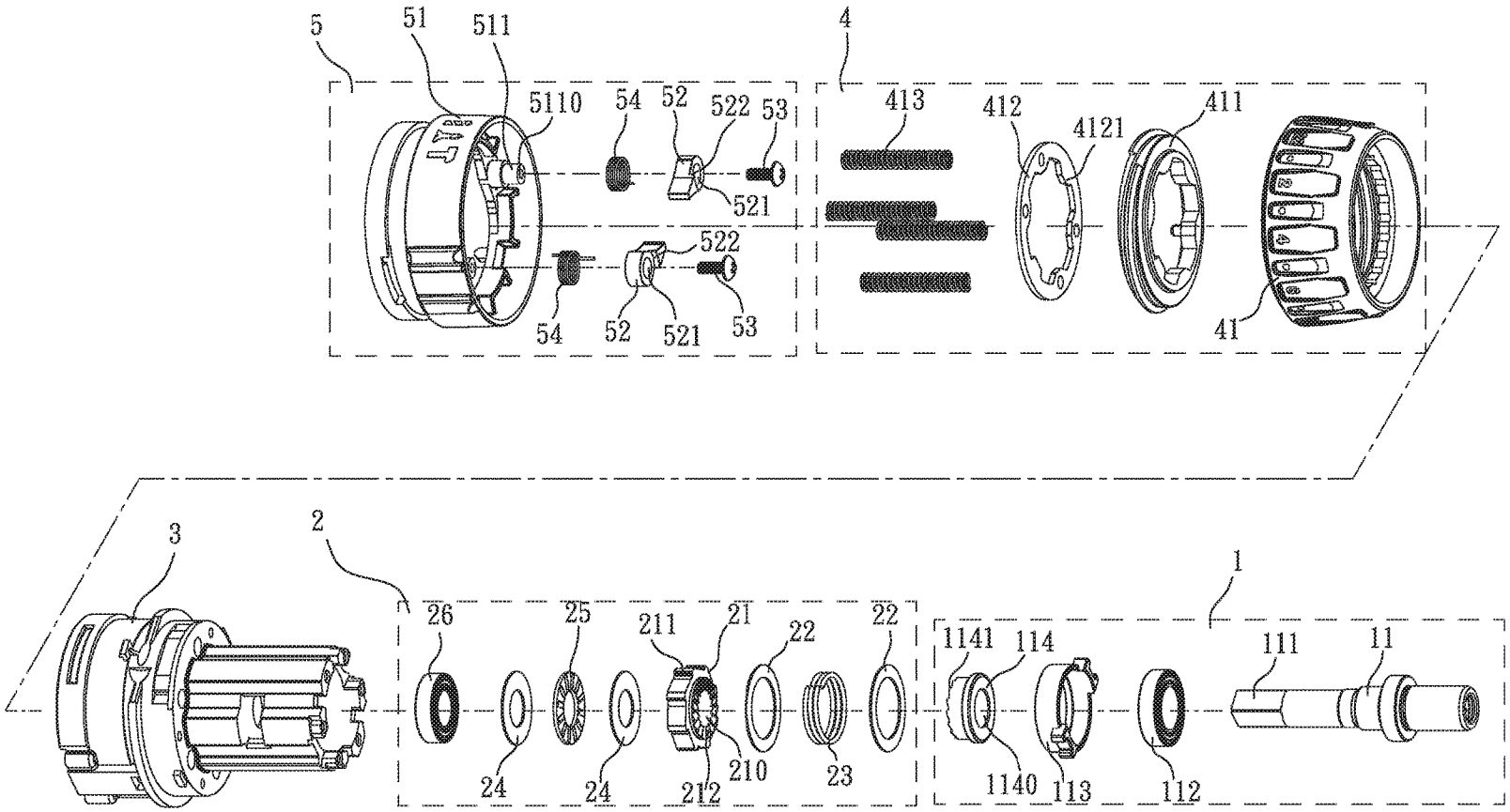
FIG. 1 is a perspective, exploded and assembling direction of all the elements constituting output-mode switching device of the present invention for the electric tool.
Figure 1B:
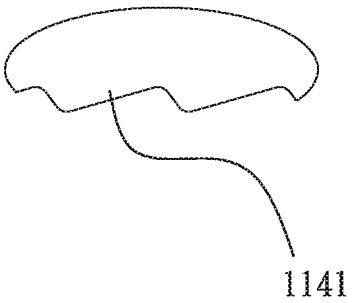
FIG. 1B is a fragmented view of ratchet teeth formed on a movable ratchet wheel employed in output-mode switching device of the present invention for the electric tool.
Figure 2:
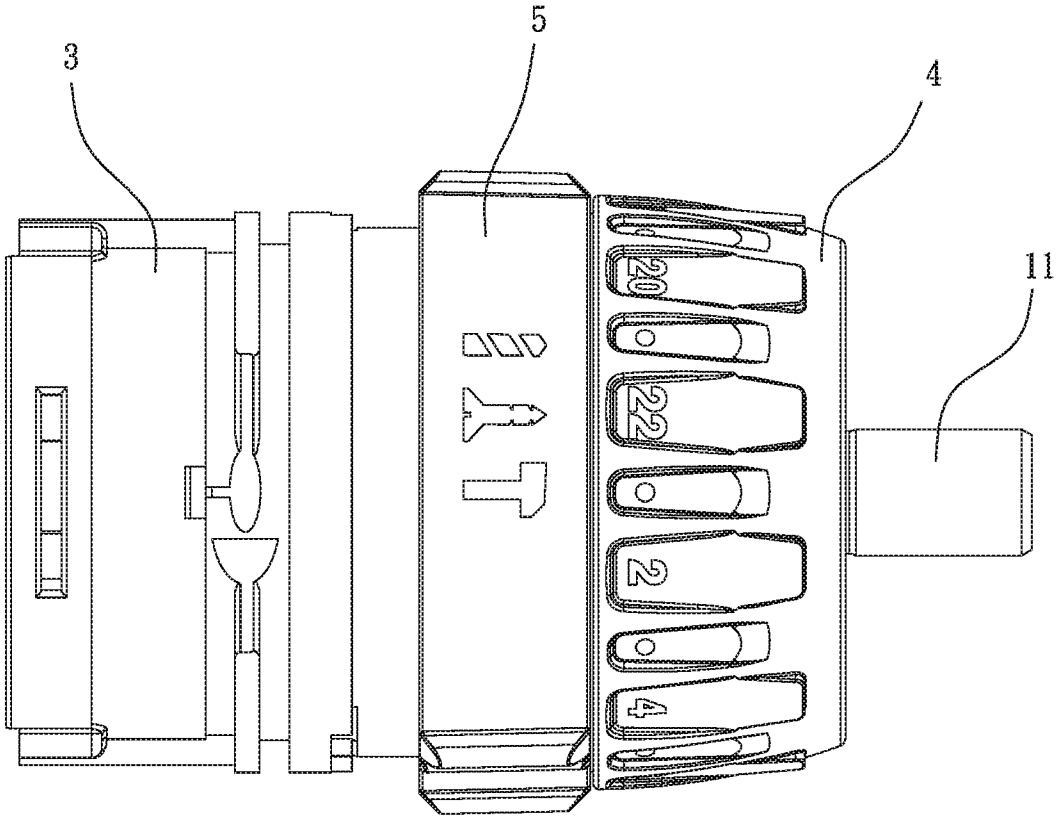
FIG. 2 is a planar view of output-mode switching device of the present invention for the electric tool.
Figure 3:
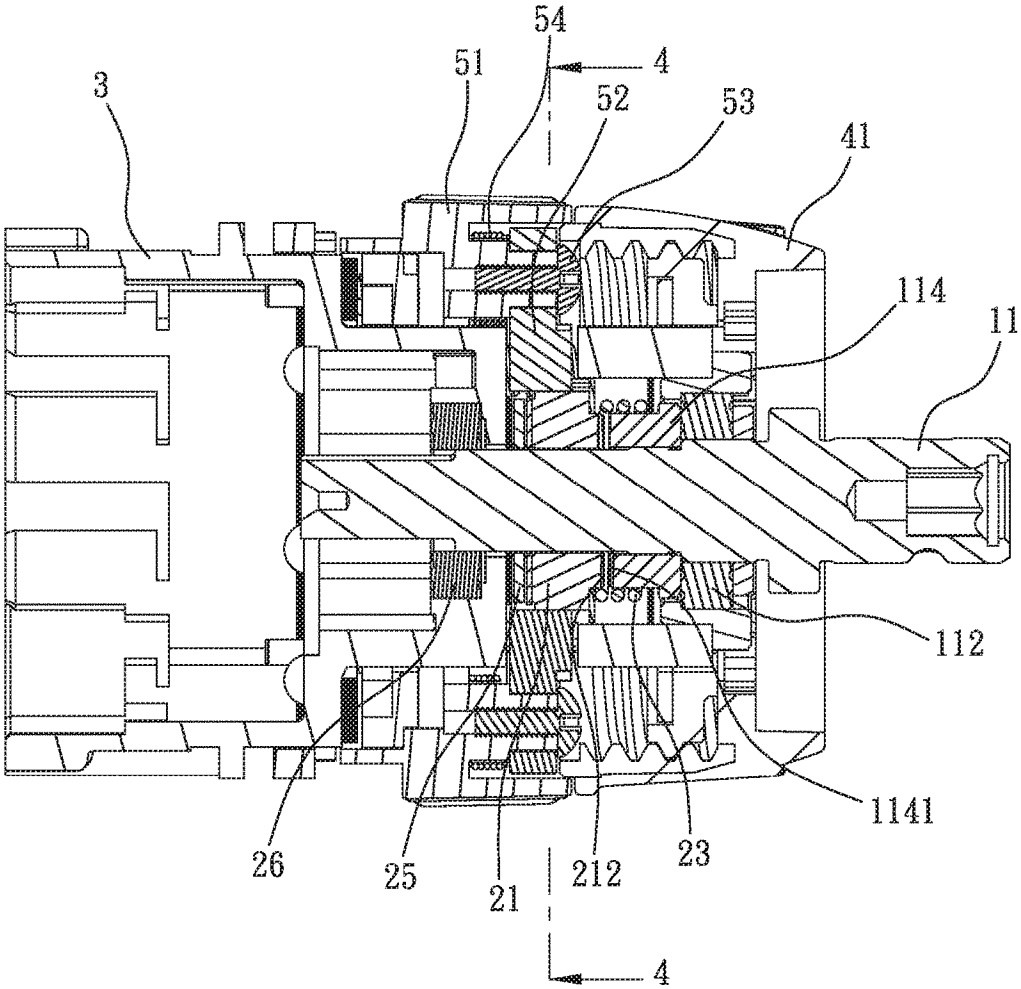
FIG. 3 is a planar cross-section view of output-mode switching device of the present invention for the electric tool shown in FIG. 2.

Referring to FIGS. 1-3, the output-mode switching device for an electric tool according to the present invention includes an output shaft unit 1, a fixed ratchet unit 2, an outer casing 3 defining an interior chamber, a toque unit 4 and a function switch unit 5, wherein the output shaft unit 1 is disposed in the interior chamber of the outer casing 3 and includes an output shaft 11, a first bearing unit 112, a nut covering 113 and a movable ratchet wheel 114. The output shaft 11 has several shaft sections with different diameters, a first shaft section 111 of polygonal cross-section extending towards the transmission structure, and a second shaft section opposite to the first shaft section 111 for clamping an operating bit, like a drill, in order to rotate the drill. The first bearing unit 112 is sleeved around the output shaft 11 at an appropriate position while the nut covering 113 and the movable ratchet wheel 114 are also sleeved around the output shaft 11 in such a manner that a polygonal hole 1140 in the movable ratchet wheel 114 engages the first shaft section 111 of the output shaft 11 so that the movable ratchet wheel 114 is movable axially along the output shaft 11 and is non-rotatable with the output shaft 11. The movable ratchet wheel 114 has a first end provided with ratchet teeth 1141 circumferentially on its external surface thereof. In this embodiment, each ratchet teeth 1141 is asymmetric as best shown in FIG. 1B, having a small inclined side and a large inclined side at the other side such that during the rotation of the movable ratchet wheel 114 in the clockwise direction, the small inclined side of the ratchet teeth 1141 provides small resistance, thereby generating high effective output. In case the movable ratchet wheel 114 is rotated in the counterclockwise direction, the large inclined side of the ratchet teeth 1141 provides resistance, thereby preventing the movable ratchet wheel 114 from rotating in the counterclockwise direction.

Figure 1A:
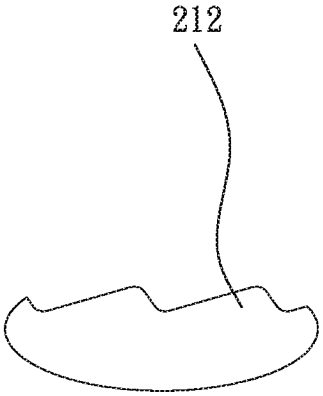
FIG. 1A is a fragmented view of ratchet teeth formed on a fixed ratchet wheel employed in output-mode switching device of the present invention for an electric tool.

The fixed ratchet unit 2 includes a fixed ratchet wheel 21, two annular first cushion pads 22, a restoration spring 23, two annular cushion pads 24, a bearing disk 25 and a first bearing unit 26, wherein the fixed ratchet wheel 21 has a through hole 210 sleeved around the first shaft section 111 the output shaft 11, a second end formed with ratchet teeth 212. In this embodiment, each of the ratchet teeth 212 is asymmetric as best shown in FIG. 1A, having a small inclined side and a large inclined side at the other side for meshing with the ratchet teeth 1141 of the movable ratchet teeth 114. The fixed ratchet wheel 21 further has a plurality of external ratchet teeth 211 formed on its outer surface. A compression spring serves as the restoration spring 23 is disposed between the movable ratchet wheel 114 and the fixed ratchet wheel 21 and having two opposite ends respectively abutting against the first end of the movable ratchet wheel 114 and the second end of the fixed ratchet wheel 21.

After assembly, the first shaft section 111 of the output shaft 11 extends sequentially through the first bearing unit 112, the nut covering 113 and the movable ratchet wheel 114, and further through one first cushion pad 22, the restoration spring 23, another first cushion pads 22, the through hole in the fixed ratchet wheel 21, one second cushion pad 24, the bearing disk 25, another second cushion pad 24 and the second bearing unit 26 such that the two first cushion pads 22 respectively abut against the second end of the fixed ratchet wheel 21 and the first end of the movable ratchet wheel 114 while two opposite ends of the restoration spring 23 respectively abutting against the cushion pads 22. The second cushion pads 24 respectively abut against the first end of the fixed ratchet wheel 21 and the second end of the second bearing unit 26 while the bearing disk 25 abuts against the second cushion pads 24. The restoration spring 23 provides an axial compression force so as to space the movable ratchet wheel 114 and the fixed ratchet wheel 21 apart from each other on the output shaft 11.

Note that the previously mentioned output shaft unit 1 and the fixed ratchet unit 2 are disposed within the interior chamber of the outer casing 3 such that all the elements mentioned above also located within the interior chamber.

The toque unit 4 includes a torque cover 41, an annular sleeve 411 coupled with the torque cover 41, an annular cushion pad 412 having a plurality of inner protrusions 4121 and a plurality of compression springs 413, wherein the torque cover 41 has inner threads for rotatably fastened with outer threads of the outer casing 3 such that the torque cover 41 is rotable relative to the outer casing 3. The annular cushion pad 412 is coupled to a first end of the annular sleeve 411, after which the torque cover 41, the annular sleeve 411 and the annular cushion pad 412 are coupled to the outer casing 3 so that the second ends of the compression springs 413 are mounted on the first end of the annular cushion pad 412.

The function switch unit 5 includes a switch ring 51 mounted rotatably on the outer casing 3 behind the toque unit 4, two pawls 52 which are mounted pivotally to screw holes 5110 in two mounting posts 511 of the switch ring 51 via two fastener screws 53 such that pivot axes of the pawls 52 extend parallel with an axis of the switch ring 51. Each of two torsion springs 54 is sleeved around a respective mounting post 511 and has two opposite ends respectively abutting against the pawls and the switch ring 51. It is to note that due to biasing action of the torsion spring 54, the pawls 52 tend pivotally towards an axis of the switch ring 51. Note that each of the pawls 52 has an abutment section 522 such that after assembly one end of each torsion spring 54 abuts against the abutment section 522 such that the engaging ends 521 of the pawls 52 abut against respective inner protrusions 4121 of the annular cushion pad 412.

The toque unit 4 is used to adjust the torque of the output shaft 11. When the torque cover 41 is rotated in a normal direction (clockwise direction) and/or in an opposite direction (counterclockwise direction) with respect to the outer casing 3, the torque cover 41 is axially moved toward the first end and/or the second end. Movement of the torque cover 41 axially toward the first end results in pressing of the compression springs 413, thereby driving the output shaft 11 in a high torque speed and movement of the torque cover 41 axially toward the second end releases pressing off the compression springs 413, thereby driving the output shaft 11 in a low torque speed.

The function switch unit 5 is used to alter the modes of the output shaft 11. There are marks provided on the outer surface of the switch ring 51, as shown in FIG. 2, wherein the middle symbol "screw" refers to rotation of the output shaft 11 in a single direction, the right symbol "hammer" refers to rotation of the output shaft 11 and simultaneously providing impact force, the left symbol "drill" refers to continuous rotation of the output shaft 11. Therefore, the operator can manually rotate the switch ring 51 to a desired position with respect to the outer casing 3, and can achieve the desired output mode of the output shaft 11.

The switching modes of the output shaft will be described in the following paragraphs.

Figure 4:
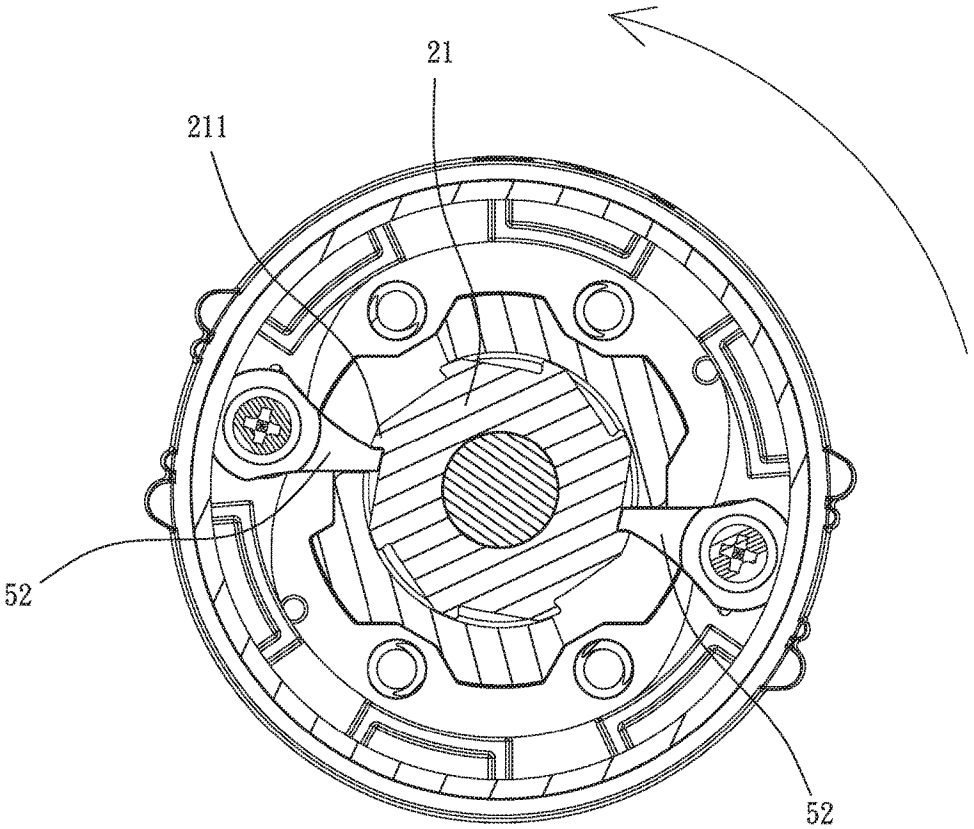
FIG. 4 is a cross-section view of output-mode switching device of the present invention for the electric tool taken along line 4-4 shown in FIG. 3, in which an output shaft rotates in a specific direction with axial impact.

As shown in FIG. 4, when the operator rotates the switch ring 51 in the clockwise direction so as to set the output mode of the output shaft 11, the engaging ends 521 of the pawls 52 are engaged and driven by the inner protrusions 4121 of the annular cushion pad 412 such that the pawls 52 engage the ratchet teeth 211 formed on the external surface of the fixed ratchet wheel 21. Since the fixed ratchet wheel 21 cannot rotate, rotation of the output shaft 11 simultaneously drives the movable ratchet wheel 114. At this time due to reciprocal biasing of the restoration spring 23, the ratchet teeth 1141 of the movable ratchet wheel 114 mesh and/or non-mesh with the ratchet teeth 212 formed on the end surface of the fixed ratchet wheel 21. Thus, the output shaft 11 rotates and provides axial impacts reciprocally during the rotation, which means that the output shaft 11 is switched to the left side symbol of "drill". It is to note that when the switch ring 51 is switched to the "drill" output mode, the fixed ratchet wheel 21 is prevented from rotating in the opposite direction due to its external ratchet teeth 211 engaging with the pawls 52, thereby preventing damage done onto the motor due to overload.

Figure 5:
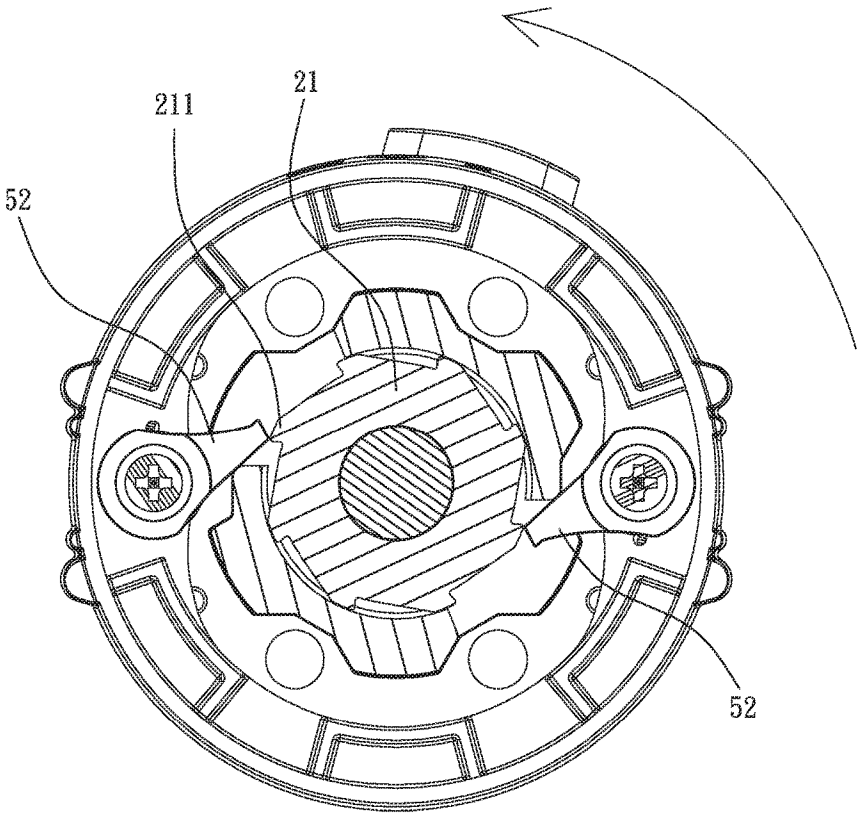
FIG. 5 is a cross-section view of output-mode switching device of the present invention for the electric tool taken along line 4-4 shown in FIG. 3, in which the output shaft rotates in the specific direction.

Referring to FIG. 5, when the operator rotates the switch ring 51 relative to the casing 30 so as to adjust the output mode ("screw" mode), the engaging ends 521 of the pawls 52 are driven by the inner protrusions 4121 of the annular cushion pad 412, thereby causing the engaging ends 521 of the pawls 52 do not fully engage the external ratchet teeth 211 of the fixed ratchet wheel 21. Thus, when the transmission structure drives the output shaft 11 to rotate in the clockwise direction, since the restoration force of the spring 23 causes meshing between the ratchet teeth 1141 of the movable ratchet wheel 114 and the ratchet teeth 212 of the fixed ratchet wheel 21, in which, rotation of the output shaft 11 in the clockwise direction simultaneously causes the movable and fixed ratchet wheels 114, 21 to rotate in the same direction. Note that at this time, since the external ratchet teeth 211 of the fixed ratchet wheel 21 are prevented by the pawls 52, the output shaft 11 is prevented from rotating in the counterclockwise direction, thereby causing rotation of the output shaft 11 in a single direction. In other words, the output shaft 11 functions as a screw driver.

Figure 6:
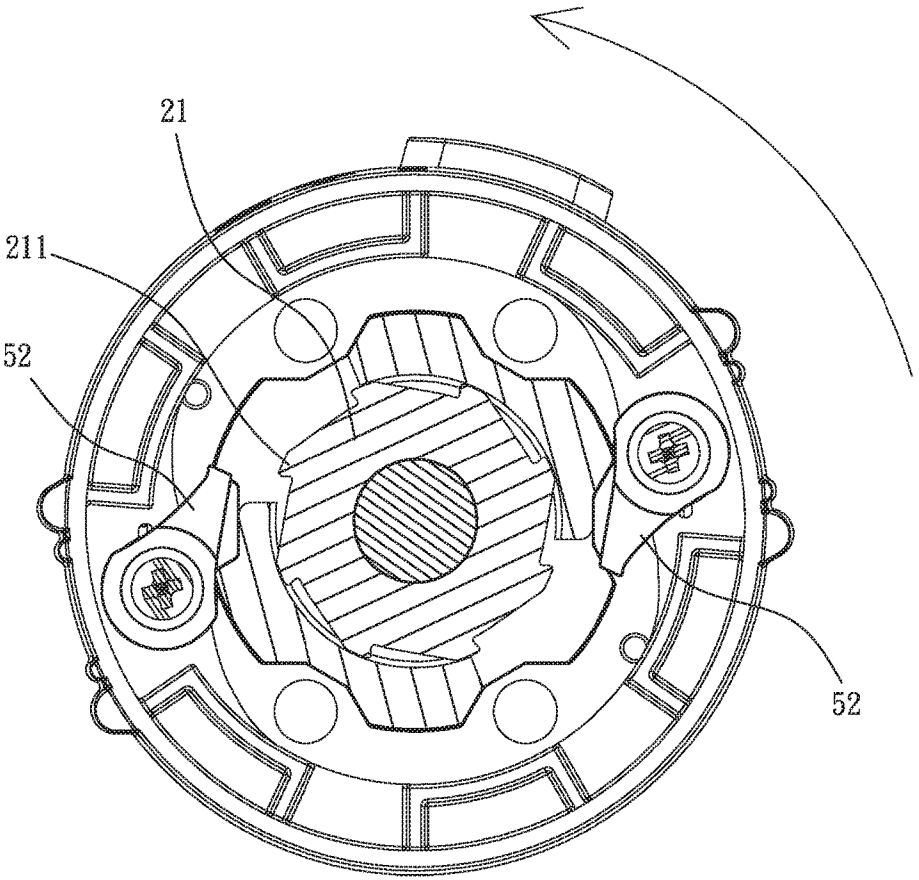
FIG. 6 is a cross-section view of output-mode switching device of the present invention for the electric tool taken along line 4-4 shown in FIG. 3, in which the output shaft rotates in the specific direction.

Referring to FIG. 6, when the operator rotates the switch ring 51 relative to the casing 30 so as to adjust the output mode ("drill" mode), the engaging ends 521 of the pawls 52 are driven by the inner protrusions 4121 of the annular cushion pad 412, thereby causing the engaging ends 521 of the pawls 52 do not engage the external ratchet teeth 211 of the fixed ratchet wheel 21. Thus, when the transmission structure drives the output shaft 11 to rotate in the clockwise direction, since the restoration force of the spring 23 causes meshing between the ratchet teeth 1141 of the movable ratchet wheel 114 and the ratchet teeth 212 of the fixed ratchet wheel 21, in which, rotation of the output shaft 11 in the clockwise direction simultaneously causes the movable and fixed ratchet wheels 114, 21 rotate in the same direction. Note that at this time, since the external ratchet teeth 211 of the fixed ratchet wheel 21 are not prevented by the pawls 52, the output shaft 11 is not prevented from rotating in the counterclockwise direction, thereby permitting rotation of the output shaft 11 in a single direction. In other words, the output shaft 11 functions as a drill.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An output-mode switching device for an electric tool, comprising:

an outer casing defining an interior chamber;

an output shaft unit disposed in said interior chamber, including an output shaft having a first shaft section and a movable ratchet wheel mounted on said first shaft section in such a manner that said movable ratchet wheel is movable axially along said output shaft and is non-rotatable with said output shaft, said movable ratchet wheel having a first end provided with ratchet teeth circumferentially on its external surface thereof;

a fixed ratchet unit including a fixed ratchet wheel that is sleeved around said first shaft section and that has a second end formed with ratchet teeth for meshing with said ratchet teeth of said movable ratchet teeth and a restoration spring, said fixed ratchet wheel further having a plurality of external ratchet teeth formed on its outer surface, said restoration spring being disposed between said movable ratchet wheel and said fixed ratchet wheel and having two opposite ends respectively abutting against said first end of said movable ratchet wheel and said second end of said fixed ratchet wheel;

a toque unit including a torque cover, an annular sleeve coupled with said torque cover, an annular cushion pad having a plurality of inner protrusions and a plurality of compression springs, said torque cover mounted rotatably on said outer casing; and a function switch unit including a switch ring mounted rotatably on said outer casing behind said toque unit, a plurality of torsion springs, and a plurality of pawls which are mounted pivotally within said switch ring such that pivot points of said pawls extend parallel with an axis of said switch ring;

wherein, rotation of said switch ring on said outer casing about its axis results in engagement of said inner protrusions of said annular cushion pad with said pawls, thereby driving said pawls about its pivot points and meshing and/or non-meshing of said pawls with said external ratchet teeth of said fixed ratchet wheel.

2. The switching device for the electric tool according to claim 1, wherein said ratchet teeth on said second end of said fixed ratchet wheel are asymmetric so do with said circumferential ratchet teeth of said movable ratchet wheel for complementing therewith.

3. The switching device for the electric tool according to claim 1, wherein each of said pawls has an abutment section for abutting against a respective one of said inner protrusions of said annular cushion pad.

4. The switching device for the electric tool according to claim 2, wherein each of said pawls has an abutment section for abutting against a respective one of said inner protrusions of said annular cushion pad.

5. The switching device for the electric tool according to claim 3, wherein said annular cushion pad has an inner wall surface from which said inner protrusions project radially and inwardly toward its axis thereof.

6. The switching device for the electric tool according to claim 4, wherein said annular cushion pad has an inner wall surface from which said inner protrusions project radially and inwardly toward its axis thereof.

* * * * *